US010365576B2

(12) United States Patent
Doi et al.

(10) Patent No.: US 10,365,576 B2
(45) Date of Patent: Jul. 30, 2019

(54) CHARGING MEMBER, METHOD FOR PRODUCING CHARGING MEMBER, PROCESS CARTRIDGE AND ELECTROPHOTOGRAPHIC IMAGE FORMING APPARATUS

(71) Applicant: CANON KABUSHIKI KAISHA, Tokyo (JP)

(72) Inventors: Noriyuki Doi, Numazu (JP); Kineo Takeno, Suntou-gun (JP); Yusuke Yagisawa, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 102 days.

(21) Appl. No.: 15/828,977

(22) Filed: Dec. 1, 2017

(65) Prior Publication Data

US 2018/0173129 A1 Jun. 21, 2018

(30) Foreign Application Priority Data

Dec. 21, 2016 (JP) ..... 2016-247848

(51) Int. Cl.
*G03G 15/02* (2006.01)
*G03G 15/04* (2006.01)
*G03G 21/18* (2006.01)

(52) U.S. Cl.
CPC ..... *G03G 15/0233* (2013.01); *G03G 21/1814* (2013.01)

(58) Field of Classification Search
CPC ..... G03G 15/01; G03G 15/02; G03G 15/025; G03G 15/04; G03G 15/0233; G03G 21/1814

(Continued)

(56) References Cited

U.S. PATENT DOCUMENTS 8,383,234 B2 2/2013 Mayuzumi et al.
8,445,113 B2 5/2013 Furukawa et al.

(Continued)

FOREIGN PATENT DOCUMENTS

EP 3088961 11/2016
JP 2001-173641 A 6/2001

(Continued)

OTHER PUBLICATIONS

U.S. Appl. No. 15/716,666, Kineo Takeno, filed Sep. 27, 2017.

*Primary Examiner* — William K Cheung
(74) *Attorney, Agent, or Firm* — Venable LLP

(57) ABSTRACT

There is provided a charging member exhibiting stable charging performance even after the use for a long period of time. The charging member includes a support and a surface layer on the support, the surface layer includes polymetalloxane containing at least one metal atom selected from the group consisting of aluminum, zirconium, titanium, and tantalum, and a group represented by the following formula (1) or (2) is bonded to at least the one metal atom in the polymetalloxane, (1)

(Continued)

-continued (2)

wherein X represents an atomic group required for forming a ring, A1 and A2 each independently represent a hydrogen atom or an alkyl group, and a symbol "*" represents a binding site with a metal atom in the polymetalloxane.

7 Claims, 4 Drawing Sheets

(58) Field of Classification Search
USPC ..... 428/411.1
See application file for complete search history.

(56) References Cited

U.S. PATENT DOCUMENTS

| | | | | |
|---|---|---|---|---|
| 8,971,766 | B2 | 3/2015 | Taniguchi et al. | |
| 9,556,359 | B2 | 1/2017 | Suzumura et al. | |
| 9,696,642 | B2 * | 7/2017 | Adachi | G03G 5/14791 |
| 2011/0217072 | A1 | 9/2011 | Kuroda et al. | |
| 2014/0072343 | A1 | 3/2014 | Masu et al. | |
| 2014/0080691 | A1 | 3/2014 | Kurachi et al. | |
| 2015/0331348 | A1 | 11/2015 | Doi et al. | |
| 2016/0161877 | A1 | 6/2016 | Masu et al. | |
| 2016/0299450 | A1 | 10/2016 | Takeno et al. | |
| 2016/0299451 | A1 | 10/2016 | Kodama et al. | |
| 2016/0378010 | A1 | 12/2016 | Doi et al. | |

FOREIGN PATENT DOCUMENTS

| | | | |
|---|---|---|---|
| JP | 2013-174907 | A | 9/2013 |
| JP | 2016-035528 | A | 3/2016 |
| JP | 2016-200819 | A | 12/2016 |

* cited by examiner

CHARGING MEMBER, METHOD FOR PRODUCING CHARGING MEMBER, PROCESS CARTRIDGE AND ELECTROPHOTOGRAPHIC IMAGE FORMING APPARATUS

BACKGROUND OF THE INVENTION

Field of the Invention

The present invention relates to a charging member, a method for producing a charging member, a process cartridge using a charging member, and an electrophotographic image forming apparatus (hereinafter, referred to as "electrophotographic apparatus").

Description of the Related Art

As one of the methods for charging a surface of an electrophotographic photosensitive member (hereinafter referred to as "photosensitive member"), there is a contact charging method. The contact charging method is a method for charging a surface of a photosensitive member by applying a voltage to a charging member arranged so as to be in contact with the photosensitive member, and by causing a slight discharge in the vicinity of the contact part between the charging member and the photosensitive member.

In the charging member used for the contact charging method, from the viewpoint of sufficiently securing the contact nip between the charging member and the photosensitive member, constitution having an electro-conductive elastic layer is generally used. However, the electro-conductive elastic layer contains a relatively large amount of low molecular weight components in many cases, and the low molecular weight components bleed to a surface of the charging member, and adhere to the photosensitive member in some cases. Therefore, for the purpose of suppressing the bleeding of the low molecular weight components to a surface of the charging member, a surface layer may be provided on the electro-conductive elastic layer.

In Japanese Patent Application Laid-Open No. 2001-173641, a method in which a surface of a base material of an electro-conductive roll is coated with an inorganic oxide film formed by a sol-gel method has been described. It is said that the inorganic oxide film formed by a sol-gel method can be produced by hydrolyzing, for example, a metal alkoxide, or an alkoxide derivative in which a part of the alkoxy group is substituted with β-diketone, β-ketoester, alkanolamine, alkyl alkanolamine, or the like.

In recent years, for an electrophotographic apparatus, further improvement in the durability is demanded, and for this reason, a charging member that exhibits stable charging performance over a long period of time is required. According to the studies of the present inventors, it was found that when an electro-conductive roll according to Japanese Patent Application Laid-Open No. 2001-173641 is used as a charging member, toner and toner external additives adhere to a surface of the charging member, and the charging performance of the charging member may be lowered in some cases.

SUMMARY OF THE INVENTION

One embodiment of the present invention is directed to provide a charging member that suppresses electrostatic adhesion of toner or external additives of toner to a surface of the charging member, and exhibits stable charging performance even after the use for a long period of time. Further, another embodiment of the present invention is directed to provide a process cartridge and an electrophotographic apparatus, which can stably form a high-quality electrophotographic image.

According to one embodiment of the present invention, there is provided a charging member including a support, and a surface layer on the support, in which the surface layer includes polymetalloxane containing at least one metal atom selected from the group consisting of aluminum, zirconium, titanium, and tantalum, and a group represented by the following formula (1) or (2) is bonded to the at least one metal atom in the polymetalloxane.

(1)

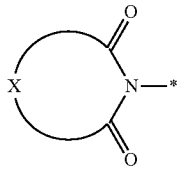

(2)

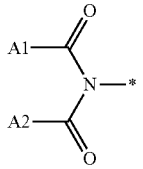

In formula (1), X represents an atomic group required for forming a ring. In formula (2), A1 and A2 each independently represent a hydrogen atom or an alkyl group. In formulas (1) and (2), a symbol "*" represents a binding site with a metal atom in the polymetalloxane.

Further, according to another embodiment of the present invention, there is provided a method for producing a charging member including a support and a surface layer on the support, in which the surface layer contains polymetalloxane, and a step for forming the surface layer includes a step of obtaining the polymetalloxane by reacting a metal alkoxide containing at least one metal selected from the group consisting of aluminum, zirconium, titanium, and tantalum with a compound represented by the following formula (3) or (4).

(3)

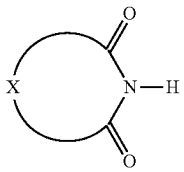

(4)

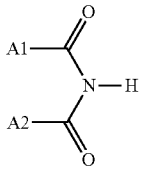

In formula (3), X represents an atomic group required for forming a ring. In formula (4), A1 and A2 each independently represent a hydrogen atom or an alkyl group.

Furthermore, according to another embodiment of the present invention, there is provided a process cartridge including an electrophotographic photosensitive member, and a charging member arranged so as to be chargeable to a surface of the electrophotographic photosensitive member, and further, configured so as to be attachable to and detachable from a main body of an electrophotographic apparatus, in which the charging member is the above-described charging member.

Still furthermore, according to another embodiment of the present invention, there is provided an electrophotographic apparatus including an electrophotographic photosensitive member, and a charging member arranged so as to be chargeable to a surface of the electrophotographic photosensitive member, in which the charging member is the above-described charging member.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

In an electrophotographic process using a negatively charged toner, in the toner remaining on the electrophotographic photosensitive member without being transferred to a recording medium (hereinafter also referred to as "transfer residual toner") or the external additives of toner (hereinafter, simply referred to as "external additives"), weakly negatively charged or positively charged ones are included. It is known that since the weakly negatively charged or positively charged toner and the external additives are electrostatically attracted to the charging member and adhere to the surface of the charging member, the charging performance of the charging member is deteriorated. This phenomenon is remarkable especially under a low temperature and low humidity environment.

As a result of investigating a method in which the adhesion of dirt to the surface of the charging member is suppressed by utilizing the fact that the toner and external additives are easily peeled off electrostatically from the charging member by negatively charging the toner and external additives adhering to the surface of the charging member at the time of rubbing, the present inventors have reached the present invention. Hereinafter, an embodiment of the present invention will be described in detail.

<Charging Member>

Hereinafter, as one embodiment of the charging member according to the present invention, the present invention will be described in detail by taking a charging member in a roller shape (hereinafter, also referred to as "charging roller") as an example. The shape of the charging member is not particularly limited, and may also be any one of the shapes such as a roller shape, and a plate shape.

Figure 1:
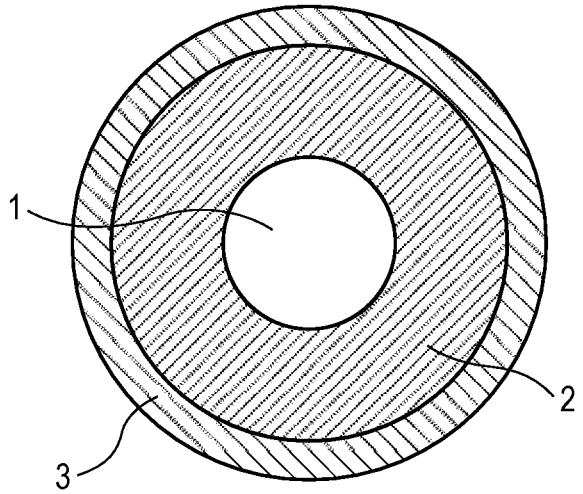
FIG. 1 is a schematic sectional view of the charging member according to one embodiment of the present invention.

FIG. 1 is a schematic sectional view of the charging roller having an elastic layer 2 and a surface layer 3, which are formed on a support 1. From the viewpoint of sufficiently securing the contact nip with the photosensitive member, the charging member preferably has a constitution with an elastic layer. The simplest constitution of the charging member having an elastic layer is a constitution in which two layers of an elastic layer and a surface layer are provided on a support. One or two or more other layers may be provided between the support and the elastic layer or between the elastic layer and the surface layer.

[Surface Layer]

Surface layer 3 includes polymetalloxane containing at least one metal atom selected from the group consisting of aluminum, zirconium, titanium, and tantalum. In addition, a group represented by the following formula (1) or (2) is bonded to the at least one metal atom in the polymetalloxane. The bond is formed by a substitution reaction of an alkoxy group of a metal alkoxide described later and a compound represented by formula (3) or (4).

(1)

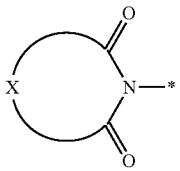

(2)

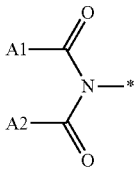

Wherein, in formula (1), X represents an atomic group required for forming a ring, in formula (2), A1 and A2 each independently represent a hydrogen atom or an alkyl group, and in formulas (1) and (2), a symbol "*" represents a binding site with a metal atom in the polymetalloxane.

The polymetalloxane is characterized in that since an organic group having a specific structure is bonded to a metal atom in the polymetalloxane, the electronic structure of the metal is changed and the electrons are easily released. Accordingly, it is considered that when toner and external additives rub against a surface of a charging member, electrons are released from a surface of a charging member, and the toner and external additives adhered to the surface of the charging member can be negatively charged. In this way, the present inventors are presumed that the toner and external additives are easily peeled off electrostatically from the charging member, and the adhesion of the toner and external additives to the surface of the charging member can be suppressed.

The present inventors investigated that as an index indicating the easiness of the release of electrons from the charging member at the time of rubbing, a triboelectric charge amount of the charging member is used. As a result, it was found that the triboelectric charge amount of the charging member is correlated with the dirt on a surface of the charging member. That is, it was found that in a case where the triboelectric charge amount (Q/M) of a charging member is negative when a standard carrier for negatively charged polar toner is used, there is a tendency that the dirt adhesion amount of the charging member becomes large, and in a case where the triboelectric charge amount (Q/M) of a charging member is plus when a standard carrier for negatively charged polar toner is used, there is a tendency that the dirt adhesion amount of the charging member becomes smaller. Note that in the present invention, as the standard carrier for negatively charged polar toner, N-01 (trade name) manufactured by The Imaging Society of Japan is used.

Specifically, in a case where the triboelectric charge amount (Q/M) of a charging member is $0.1\times10^{-3}$ (0.1 E-3) μC/g or more when a standard carrier for negatively charged polar toner (trade name: N-01, manufactured by The Imaging Society of Japan) is used, sufficient charge amount is obtained so that the toner and external additives are peeled off electrostatically from the charging member, and the dirt adhesion amount of the charging member becomes smaller, therefore, this is preferred.

At least one group selected from the groups represented by the formulas (1) and (2) is preferably contained in the polymetalloxane in an amount of 0.2 mol or more and 3 mol or less based on one mol of the metal atoms (aluminum, zirconium, titanium and tantalum) contained in the polymetalloxane. When the content of at least one group selected from the groups represented by the formulas (1) and (2) is 0.2 mol or more, the effect of suppressing the adhesion of the toner and external additives to a surface of the charging member becomes more favorable. Further, when the content of at least one group selected from the groups represented by the formulas (1) and (2) is 3 mol or less, the film property (smoothness and strength of the film) of the surface layer 3 becomes more favorable.

In formula (1), X represents an atomic group required for forming a ring. The ring containing the X may have a double bond. In addition, the ring containing the X may have a structure condensed further with another ring. The ring containing the X is preferably a 5-membered ring or a 6-membered ring. The ring containing the X may have a substituent. Specific examples of the substituent include an alkyl group having 1 to 6 carbon atoms such as a methyl group, an ethyl group, an n-propyl group, an isopropyl group, an n-butyl group, a sec-butyl group, a tert-butyl group, an n-pentyl group, an isopentyl group, a neopentyl group, a hexyl group, and a cyclohexyl group; and an aryl group having 6 to 20 carbon atoms such as a phenyl group, and a tolyl group. The ring containing the X may have multiple substituents. Specific examples of the group represented by the formula (1) include the groups shown in (1a) to (1f) of Table 1. Note that a group having one or multiple of the substituents on a ring containing X in the groups represented by formulas (1a) to (1f) can also be similarly mentioned.

TABLE 1

(1a)

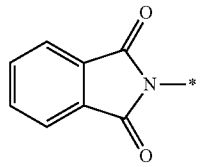

(1b)

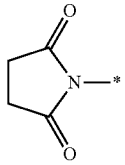

(1c)

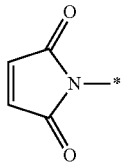

(1d)

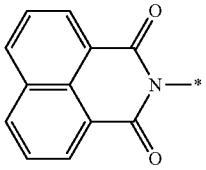

(1e)

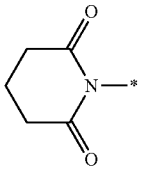

(1f)

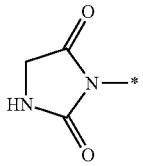

In formula (2), A1 and A2 each independently represent a hydrogen atom or an alkyl group. As the alkyl group, specifically, an alkyl group having 1 to 6 carbon atoms such as a methyl group, an ethyl group, an n-propyl group, an isopropyl group, an n-butyl group, a sec-butyl group, a tert-butyl group, an n-pentyl group, an isopentyl group, a neopentyl group, a hexyl group, and a cyclohexyl group can be mentioned. A1 and A2 may be the same as or different from each other.

(Forming Method of Surface Layer)

The surface layer according to the present invention is formed, for example, via the following steps (i) and (ii):

(i) a step of preparing a coating liquid for forming a surface layer, and (ii) a step of coating the coating liquid to form a coating film, and drying the coating film.

Hereinafter, each step will be described.

(i) Step of Preparing a Coating Liquid for Forming a Surface Layer

A coating liquid can be prepared by mixing a metal alkoxide and at least one compound selected from the compounds represented by the following formulas (3) and (4) in an organic solvent. That is, in a method for producing the charging member according to the present invention, the step for forming a surface layer includes a step of obtaining polymetalloxane by reacting a metal alkoxide containing at least one metal selected from the group consisting of aluminum, zirconium, titanium, and tantalum with a compound represented by the following formula (3) or (4).

(3)

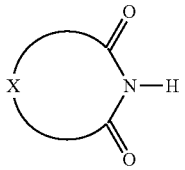

(4)

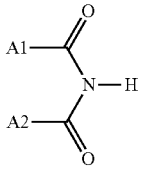

In formula (3), X has the same meaning as the X in the formula (1) and represents an atomic group required for forming a ring, and the ring containing the X has the same meaning as the ring containing X in the formula (1). Specific examples of the compound represented by the formula (3) include the compounds shown in (3a) to (3f) of Table 2. Note that a compound having one or multiple of the substituents described for the formula (1) on a ring containing X in the compounds represented by formulas (3a) to (3f) can also be similarly mentioned.

TABLE 2

(3a)

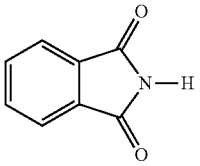

(3b)

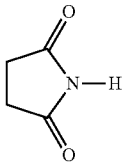

(3c)

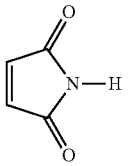

(3d)

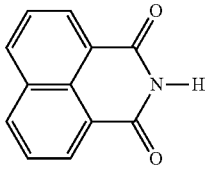

TABLE 2-continued (3e)

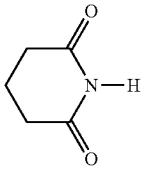

(3f)

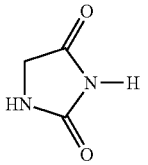

In formula (4), A1 and A2 have the same meaning as the A1 and A2 in the formula (2).

As the metal alkoxide, a metal alkoxide containing at least one metal atom selected from the group consisting of aluminum, zirconium, titanium, and tantalum is used. Among them, an alkoxide of aluminum and/or zirconium is preferred. Examples of the alkoxide include methoxide, ethoxide, n-propoxide, isopropoxide, n-butoxide, 2-butoxide, and t-butoxide. Multiple metal alkoxides may be used in combination.

The addition amount of the compound represented by at least one structure selected from the formulas (3) and (4) is preferably 0.2 mol or more and 3 mol or less based on one mol of the metal alkoxide. When the addition amount of the compound is 0.2 mol or more, the effect of suppressing the adhesion of the toner and external additives to a surface of the charging member becomes more favorable. Further, when the addition amount of the compound is 3 mol or less, the film forming property of the coating liquid becomes more favorable.

The organic solvent is not particularly limited as long as the organic solvent is a solvent capable of dissolving the metal alkoxide and the compounds represented by the formulas (3) and (4). As the organic solvent, for example, an alcohol-based solvent, an ether-based solvent, a cellosolve-based solvent, a ketone-based solvent, an ester-based solvent, or the like is used. Specific examples of the alcohol-based solvent include methanol, ethanol, n-propanol, isopropyl alcohol, 1-butanol, 2-butanol, t-butyl alcohol, 1-pentanol, and cyclohexanol. Specific example of the ether-based solvent includes dimethoxyethane. Specific examples of the cellosolve-based solvent include methyl cellosolve, and ethyl cellosolve. Specific examples of the ketone-based solvent include acetone, methyl ethyl ketone, and methyl isobutyl ketone. Specific examples of the ester-based solvent include methyl acetate, and ethyl acetate. The organic solvents may be used singly alone, or by mixing two or more kinds thereof.

In order to promote the reaction of condensing the metal alkoxide to obtain polymetalloxane, water, an acid, an alkali, or the like may be added as a catalyst. Examples of the acid include p-toluenesulfonic acid, benzenesulfonic acid, methanesulfonic acid, acetic acid, and hydrochloric acid. Examples of the alkali include sodium hydroxide, potassium hydroxide, ammonia water, and a triethylamine aqueous solution. The catalysts may be used singly alone, or in combination of two or more kinds thereof. In a case of using a catalyst, from the viewpoint of the coating liquid stability, the addition amount of the catalyst is preferably 0.01 mol to 0.2 mol based on one mol of the metal alkoxide.

In order to further improve the film property (smoothness and strength of the film) of the surface layer 3, an alkoxysilane can also be added into the coating liquid. Examples of the alkoxysilane to be used include tetraalkoxysilane, trialkoxysilane, and dialkoxysilane.

Specific examples of the tetraalkoxysilane include tetramethoxysilane, tetraethoxysilane, tetra(n-propoxy) silane, tetra(isopropoxy) silane, tetra(n-butoxy) silane, tetra(2-butoxy) silane, tetra(t-butoxy) silane, trimethoxy(isopropoxy) silane, trimethoxy(n-butoxy) silane, trimethoxy(2-butoxy) silane, trimethoxy(t-butoxy) silane, triethoxy(isopropoxy) silane, triethoxy(n-butoxy) silane, triethoxy(2-butoxy) silane, and triethoxy(t-butoxy) silane.

Examples of the trialkoxysilane include trimethoxysilanes such as trimethoxy hydrosilane, trimethoxy methyl silane, trimethoxy ethyl silane, trimethoxy(n-propyl) silane, trimethoxy(n-hexyl) silane, trimethoxy(n-octyl) silane, trimethoxy(n-decyl) silane, trimethoxy(n-dodecyl) silane, trimethoxy(n-tetradecyl) silane, trimethoxy(n-pentadecyl) silane, trimethoxy(n-hexadecyl) silane, trimethoxy(n-octadecyl) silane, trimethoxy cyclohexyl silane, trimethoxy phenyl silane, and trimethoxy(3-glycidyl propyl) silane; and triethoxysilanes such as triethoxy hydrosilane, triethoxy methyl silane, triethoxy ethyl silane, triethoxy(n-propyl) silane, triethoxy(n-hexyl) silane, triethoxy(n-octyl) silane, triethoxy(n-decyl) silane, triethoxy(n-dodecyl) silane, triethoxy(n-tetradecyl) silane, triethoxy(n-pentadecyl) silane, triethoxy(n-hexadecyl) silane, triethoxy(n-octadecyl) silane, triethoxy cyclohexyl silane, triethoxy phenyl silane, and triethoxy(3-glycidylpropyl) silane.

Specific examples of the dialkoxysilane include dimethoxysilanes such as dimethoxydimethylsilane, dimethoxydiethylsilane, dimethoxymethylphenylsilane, dimethoxydiphenylsilane, and dimethoxy(bis-3-glycidylpropyl) silane; and diethoxysilanes such as diethoxydimethylsilane, diethoxydiethylsilane, diethoxymethylphenylsilane, diethoxydiphenylsilane, and diethoxy(bis-3-glycidylpropyl) silane.

(ii) Step of Coating the Coating Liquid to Form a Coating Film, and Drying the Coating Film The method in which a coating liquid is applied to form a coating film and the coating film is dried to form a surface layer 3 is not particularly limited, and a known method that is generally used can be selected and used. As the method for applying a coating liquid, specifically, applying with the use of a roll coater, dip coating, and ring coating can be mentioned. After the coating film is formed by applying the coating liquid, the solvent is dried, and a heat treatment can also be performed in order to promote the condensation. In addition, by performing a surface treatment on the surface layer, surface physical properties such as dynamic friction and surface free energy can be adjusted. Specifically, a method of irradiating a surface of the formed surface layer with an active energy rays can be mentioned. Examples of the active energy ray to be used include a UV ray, an infrared ray, and an electron beam.

The thickness of the surface layer 3 is preferably 0.003 μm to 30 μm, and more preferably 0.003 μm to 5 μm. The thickness of the surface layer 3 can be adjusted by the solid content concentration of the coating liquid, and the solid content concentration is preferably around 0.01% by mass to 20% by mass.

It can be confirmed that the group represented by the formula (1) or (2) is bonded to at least one metal atom in the polymetalloxane contained in the surface layer 3, for example, by analyzing the surface layer by X-ray photoelectron spectroscopy (ESCA: electron spectroscopy for chemical analysis) using X-ray photoelectron spectroscopic analyzer.

[Support]

The support is not particularly limited as long as the support has electro-conductivity, and can support a surface layer, an elastic layer, and the like, and further, is a support that can maintain the strength as a charging member, typically as a charging roller. In a case where the charging member is a charging roller, the support is a solid columnar body or a hollow cylindrical body, the length of the support is, for example, around 244 to 354 mm, and the outer diameter is, for example, around 5 to 12 mm. The support is required to have sufficient rigidity so that the charging roller comes into contact with the photosensitive member, and a metal material is preferably used for the support. Specific examples of the metal material include iron, copper, stainless steel, aluminum, an aluminum alloy, and nickel. In addition, a support made of a resin, which is reinforced with a filler, can be used. In that case, the resin material itself may be made electro-conductive, or the surface may be subjected to a conductive treatment, for example, a metal film may be formed.

[Elastic Layer]

The elastic layer is constituted to have predetermined electro-conductivity by containing a conductive agent. The elastic layer preferably has a volume resistivity of $1\times10^2$ Ωcm or more and $1\times10^9$ Ωcm or less. The elastic layer is constituted of a vulcanizate of a rubber composition in which a conductive agent, a crosslinking agent, and the like are appropriately mixed in raw material rubber. As the raw material rubber, butadiene rubber, isoprene rubber, chloroprene rubber, acrylonitrile-butadiene rubber, styrene-butadiene rubber, or the like is suitably used.

Mechanism for imparting the electro-conductivity is roughly divided into two types of ionic conduction mechanism and electronic conduction mechanism.

The rubber composition of the ionic conduction mechanism is generally a composition made of a polar rubber represented by chloroprene rubber, and acrylonitrile-butadiene rubber, and an ion conductive agent. The ion conductive agent is an ion conductive agent that ionizes in the polar rubber, and further has a high mobility of the ionized ion.

The rubber composition of the electronic conduction mechanism is generally a composition in which carbon black, carbon fiber, graphite, metal fine powder, a metal oxide, or the like is dispersed as electro-conductive particles in rubber. The rubber composition of the electronic conduction mechanism has advantages that, as compared with the rubber composition of the ionic conduction mechanism, the temperature/humidity dependency of the electric resistance value is smaller, the bleeding and the blooming are smaller, the cost is smaller, and the like. Accordingly, it is preferred to use the rubber composition of the electronic conduction mechanism.

As the electro-conductive particles, the following can be mentioned. Electro-conductive carbon such as Ketjenblack EC, and an acetylene black; carbon for rubber such as SAF, ISAF, HAF, FEF, GPF, SRF, FT, and MT; tin oxide, titanium oxide, zinc oxide, a metal such as copper, and silver and a metal oxide thereof; carbon for color (ink) in which an oxidation treatment has been performed, pyrolytic carbon, natural graphite, artificial graphite; and the like. As the electro-conductive particles, electro-conductive particles that do not form large convex portions on a surface of the elastic layer are preferred, and electro-conductive particles that have an average particle diameter of 10 nm to 300 nm are preferably used. The use amount of these electro-conductive particles can be appropriately selected depending on the kind of raw material rubber, the electro-conductive particles, and other compounding agents so that the rubber composition has a desired electric resistance value. For example, based on 100 parts by mass of the raw material rubber, the electro-conductive particles can be set to be 0.5 parts by mass or more and 120 parts by mass or less, and preferably 2 parts by mass or more and 100 parts by mass or less.

In addition, in the rubber composition, other conductive agents, a filler, a processing aid, an age resister, a crosslinking aid, a crosslinking accelerator, a crosslinking accelerating aid, a crosslinking retarder, a dispersant, and the like can be contained.

As the material for constituting the elastic layer, one kind or two or more kinds selected from elastic bodies such as rubber and thermoplastic elastomer that are conventionally used as an elastic layer of a charging member can be used. Specific examples of the rubber include urethane rubber, silicone rubber, butadiene rubber, isoprene rubber, chloroprene rubber, styrene-butadiene rubber, ethylene-propylene rubber, polynorbornene rubber, acrylonitrile rubber, epichlorohydrin rubber, and alkyl ether rubber. Examples of the thermoplastic elastomer include styrene-based elastomer, and olefin-based elastomer.

The hardness of the elastic layer is, from the viewpoint of suppressing the deformation of a charging member when the charging member and a photosensitive member as the member to be charged are brought into contact with each other, preferably 25 degrees or more and 95 degrees or less in Asker C hardness. In addition, the elastic layer preferably has a so-called crown shape in which the layer thickness in the central part is thicker than the layer thickness in the end part so as to be brought into contact with a photosensitive member uniformly in the width direction. The thickness of the elastic layer is preferably 0.1 mm to 10 mm, and more preferably 0.5 mm to 5 mm.

<Electrophotographic Apparatus and Process Cartridge>

Figure 2:
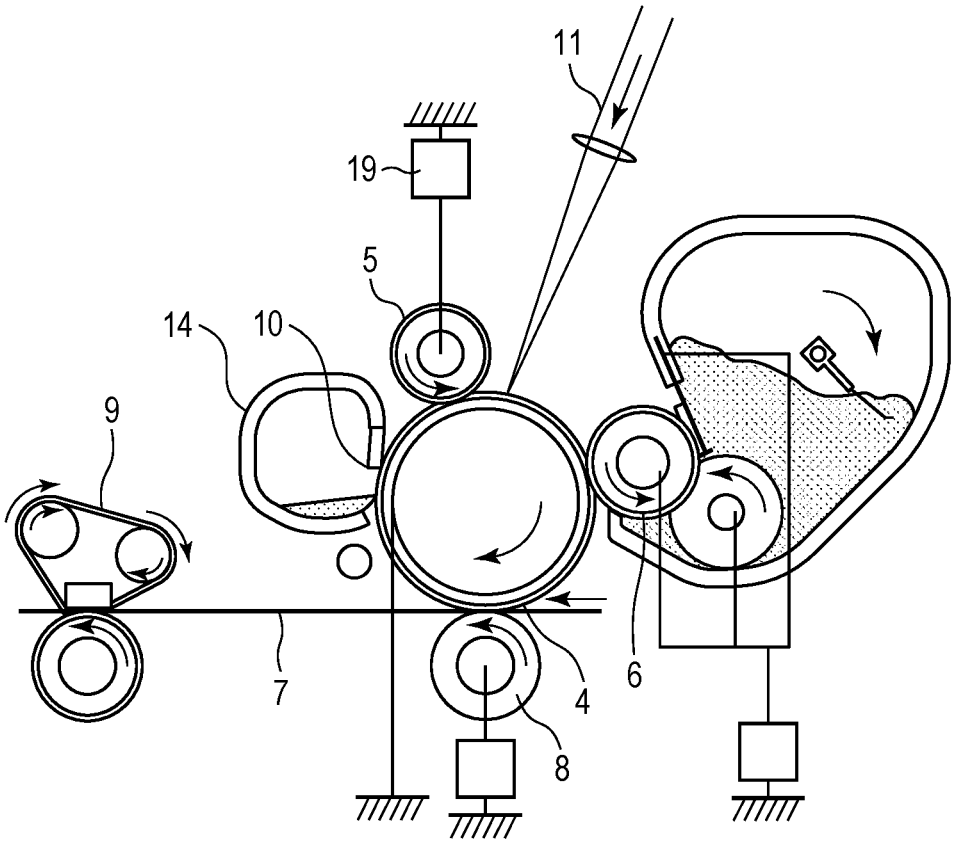
FIG. 2 is a schematic view of the electrophotographic apparatus according to one embodiment of the present invention.
Figure 3:
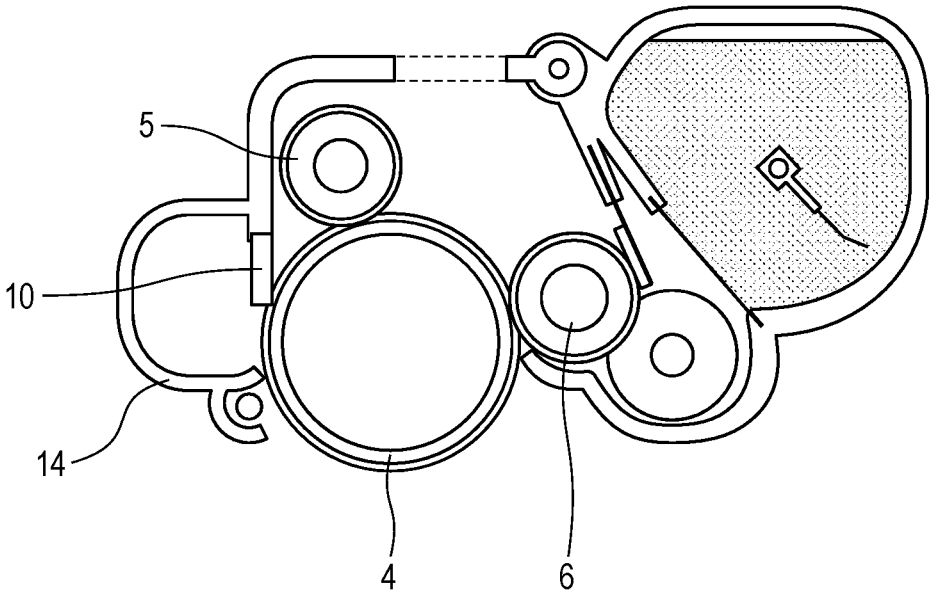
FIG. 3 is a schematic view of the process cartridge according to one embodiment of the present invention.

FIG. 2 shows one example of an electrophotographic apparatus having the charging member of the present invention. In addition, FIG. 3 shows one example of a process cartridge having the charging member of the present invention.

The photosensitive member 4 is a rotary drum type image bearing member. The photosensitive member 4 is rotationally driven at a predetermined peripheral speed clockwise as indicated by the arrow in FIG. 2.

The charging unit is constituted of a charging roller 5 that is a charging member, and a charging bias application power source 19 for applying a charging bias to the charging roller 5. The charging roller 5 is brought into contact with a surface of the photosensitive member 4 with a predetermined pressing force, and is rotationally driven in a forward direction with respect to the rotation of the photosensitive member 4. A predetermined DC voltage (set to be −1050 V in Examples described later) is applied to the charging roller 5 from the charging bias application power source 19 (DC charging system), and the surface of the photosensitive member 4 is uniformly charged to a predetermined polarity potential (in Examples described later, the dark part potential is set to be −500 V).

Next, an image exposure corresponding to the target image information is formed on the charged surface of the photosensitive member 4 by an exposure unit 11. By selectively decreasing (attenuating) the electric potential in the exposed bright part on the charged surface of the photosensitive member (in Examples described later, the bright part potential is set to be −150 V), the electrostatic latent image is formed on the photosensitive member 4. As the exposure unit 11, a known unit can be used, and for example, a laser beam scanner can be suitably mentioned.

The developing roller 6 selectively attaches the toner (negative toner) that is charged to the same polarity as the charge polarity of the photosensitive member 4 to the electrostatic latent image in the exposed bright part on a surface of the photosensitive member 4 so as to visualize the electrostatic latent image as a toner image. In Examples described later, the developing bias is set to be −400V. The development system is not particularly limited, as the development system, for example, a jumping development system, a contact development system, a magnetic brush system, or the like can be used. However, in particular, for an electrophotographic apparatus that outputs a color image, a contact development system is preferred from the viewpoint of improving the toner scattering property and the like.

The transfer roller 8 is brought into contact with the photosensitive member 4 with a predetermined pressing force, and rotates at a peripheral speed substantially equal to the rotational peripheral speed of the photosensitive member 4 in a forward direction to the rotation of the photosensitive member 4. In addition, to the transfer roller 8, a transfer voltage having a polarity opposite to that of the charging characteristics of toner is applied from a transfer bias application power source. A transfer material 7 is fed at a predetermined timing from a paper feed mechanism (not shown) to a contact part between the photosensitive member 4 and the transfer roller 8, and the back surface of the transfer material 7 is charged to a polarity opposite to the charge polarity of the toner by a transfer roller 8 to which the transfer voltage is applied. In this way, in the contact part between the photosensitive member 4 and the transfer roller 8, the toner image on the photosensitive member side is electrostatically transferred to the front side of the transfer material 7. As the transfer roller 8, a known unit can be used. Specifically, a transfer roller formed by coating an elastic layer that has been adjusted to medium resistance on an electro-conductive support such as a metal can be mentioned.

The transfer material 7, to which the toner image has been transferred, is separated from the surface of the photosensitive member and introduced into a fixing device 9, and is subjected to the fixing of the toner image and outputted as an image formed matter. In a case of the both-side image formation mode and the multiple image formation mode, the image formed matter is introduced into the recirculation conveying mechanism (not shown), and is reintroduced into the transfer section. Residues such as transfer residual toner remaining on the photosensitive member 4 are recovered from the photosensitive member 4 by a cleaning device 14 having a cleaning blade 10. In a case where the residual charge remains on the photosensitive member 4, it is preferred that after the transfer, before the primary charging by the charging roller 5 is performed, the residual charge of the photosensitive member 4 is removed by a pre-exposure device (not shown).

The process cartridge according to the present invention is provided with at least a photosensitive member, and a charging member arranged so as to be chargeable to a surface of the photosensitive member, and is configured so as to be attachable to and detachable from a main body of an electrophotographic apparatus. Further, as the charging member, the charging member according to the present invention is provided. In Examples described later, a process cartridge integrally supporting a charging roller 5, a photosensitive member 4, a developing roller 6, and a cleaning device 14 having a cleaning blade 10 was used.

According to one embodiment of the present invention, the adhesion of the toner and external additives to a surface of a charging member is suppressed, and a charging member exhibiting stable charging performance even after the use for a long period of time can be obtained.

Further, according to another embodiment of the present invention, a process cartridge and an electrophotographic apparatus, which can stably form a high-quality electrophotographic image, can be obtained.

EXAMPLES

Hereinafter, the present invention will be described in more detail by way of specific examples. In the following Examples, "parts" means "parts by mass" unless otherwise specifically noted. A list of reagents used in Examples is shown in Table 3.

TABLE 3

| Reagent | Manufacturer | CAS number |
|---|---|---|
| Dimethoxyethane | KISHIDA CHEMICAL Co., Ltd. | 110-71-4 |
| 2-Butanol | KISHIDA CHEMICAL Co., Ltd. | 78-92-2 |
| Ion exchanged water | KISHIDA CHEMICAL Co., Ltd. | 7732-18-5 |
| Aluminum sec-butoxide | Tokyo Chemical Industry Co., Ltd. | 2269-22-9 |
| Zirconium n-propoxide 70% n-propanol solution | Tokyo Chemical Industry Co., Ltd. | 23519-77-9 |
| Phthalimide | Tokyo Chemical Industry Co., Ltd. | 85-41-6 |
| 1,8-Naphthalimide | Tokyo Chemical Industry Co., Ltd. | 81-83-4 |
| Succinimide | Tokyo Chemical Industry Co., Ltd. | 123-56-8 |
| 5,5-Dimethylhydantoin | Tokyo Chemical Industry Co., Ltd. | 77-71-4 |
| Diacetamide | Sigma-Aldrich Co. LLC . | 625-77-4 |
| p-Toluenesulfonic acid × monohydrate | Tokyo Chemical Industry Co., Ltd. | 104-15-4 |
| Acetylacetone | KISHIDA CHEMICAL Co., Ltd. | 123-54-6 |

<Production of Electro-Conductive Elastic Roller A>

The materials shown in Table 4 were mixed for 24 minutes under the conditions of a packing ratio of 70% by volume and a blade rotational speed of 30 rpm using a 6 L-pressure kneader (trade name: TD6-15MDX, manufactured by Toshin. Co., Ltd.), and an unvulcanized rubber composition was obtained. To 174 parts of this unvulcanized rubber composition, 4.5 parts of tetrabenzyl thiuram disulfide (trade name: Sanceler TBzTD, manufactured by SANSHIN CHEMICAL INDUSTRY CO., LTD.) as a vulcanization accelerator, and 1.2 parts of sulfur as a vulcanizing agent were added. Subsequently, the resultant mixture was bilaterally cut 20 times in total at a front roll rotation speed of 8 rpm, a back roll rotation speed of 10 rpm, and a roll gap of 2 mm, using open rolls each having a roll diameter of 12 inches. After that, the mixture was subjected to tight milling 10 times by setting the roll gap to be 0.5 mm, and a kneaded material A for electro-conductive elastic layer was obtained.

TABLE 4

| Raw material | Used amount (parts) |
|---|---|
| Middle high nitrile NBR<br>Trade name: Nipol DN219, manufactured by ZEON CORPORATION | 100 |
| Carbon black for color<br>Trade name: #7360, manufactured by TOKAI CARBON CO., LTD. | 48 |
| Calcium carbonate<br>Trade name: Nanox #30, manufactured by MARUO CALCIUM CO., LTD. | 20 |
| Zinc oxide | 5 |
| Stearic acid | 1 |

Next, a support that has a columnar shape having a diameter of 6 mm and a length of 252 mm, and is made of iron (having a nickel-plated surface, hereinafter, referred to as "mandrel") was prepared. Subsequently, in a region up to 115.5 mm on both sides across the center in the axial direction on the mandrel (in the region having a width of 231 mm in the axis direction in total), a thermosetting adhesive containing metal and rubber (trade name: Metaloc U-20, manufactured by TOYOKAGAKU KENKYUSHO CO., LTD.) was applied. This was dried at a temperature of 80° C. for 30 minutes, and then further dried at 120° C. for 1 hour to form an adhesive layer.

The kneaded material A prepared previously was extruded at the same time into a cylindrical shape having an outer diameter of 8.75 to 8.90 mm coaxially around the mandrel having the above-described adhesive layer by extrusion molding using a crosshead, the end part was cut off, and an unvulcanized electro-conductive elastic layer was laminated on the outer periphery of the mandrel. As the extruder, an extruder having a cylinder diameter of 70 mm and L/D=20 was used, and as to the temperature control during extrusion, the temperature of the head, the cylinder, and the screw was set to be 90° C.

Next, the obtained roller was vulcanized using a continuous heating furnace provided with two zones that are set to be a temperature different from each other. The temperature of the first zone was set to be 80° C., and the passing was performed in 30 minutes, and then the temperature of the second zone was set to be 160° C., and the passing was also performed in 30 minutes, and an electro-conductive elastic roller was obtained.

Next, both ends of the electro-conductive elastic layer part (rubber part) of the electro-conductive elastic roller were cut off, and the width in the axis direction of the electro-conductive elastic layer part was set to be 232 mm. After that, the surface of the electro-conductive elastic layer part was polished with a rotating grindstone (with a work rotation speed of 333 rpm, a grindstone rotation speed of 2080 rpm, and a polishing time of 12 sec). In this way, an electro-conductive elastic roller A having a crown shape with an end diameter of 8.26 mm and a central part diameter of 8.50 mm, and further having a ten-point average roughness Rz of the surface of 5.5 μm, a deflection of 18 μm, and a hardness of 73 degrees (Asker C) was obtained.

The ten-point average roughness Rz was measured in accordance with JIS B 6101. The measurement of the deflection was performed using a high precision laser measuring instrument LSM430v (trade name) manufactured by Mitutoyo Corporation. For more details, the outer diameter of the electro-conductive elastic roller A was measured using the measuring instrument, the difference between the maximum outer diameter value and the minimum outer diameter value was defined as an outer diameter difference deflection, and then this measurement was performed at 5 points, and the average value of the outer diameter difference deflections at the 5 points was defined as the deflection of the object to be measured. The measurement of the Asker C hardness was performed under the condition of a load of 1000 g by bringing a push needle of an Asker C type hardness meter (manufactured by KOBUNSHI KEIKI CO., LTD.) against the surface of the object to be measured under a measurement environment of 25° C. and 55% RH.

<Preparation of Coating Liquid>

(Preparation of Coating Liquid E-1)

In a flask, 0.49 g of phthalimide, 35.09 g of dimethoxyethane, and 15.04 g of 2-butanol were weighed out, and then the mixture was stirred while being heated and thoroughly dissolved to prepare a phthalimide solution.

In a separate container, 18.53 g of 2-butanol and 1.05 g of aluminum sec-butoxide were weighed out, and the mixture was stirred to prepare an aluminum sec-butoxide/2-butanol solution.

The phthalimide solution prepared previously was slightly cooled, and then into the resultant solution, the aluminum sec-butoxide/2-butanol solution was added, and the mixture was refluxed for around 2 hours to prepare a coating liquid E-1.

(Preparation of Coating Liquid E-2)

In a flask, 0.48 g of phthalimide, 35.09 g of dimethoxyethane, and 15.08 g of 2-butanol were weighed out, and then the mixture was stirred while being heated and thoroughly dissolved to prepare a phthalimide solution.

In a separate container, 18.53 g of 2-butanol and 1.08 g of aluminum sec-butoxide were weighed out, and the mixture was stirred to prepare an aluminum sec-butoxide/2-butanol solution.

The phthalimide solution prepared previously was slightly cooled, and then into the resultant solution, the aluminum sec-butoxide/2-butanol solution was added, and the mixture was refluxed for around one hour. The obtained solution was slightly cooled, and then into the resultant solution, 0.084 g of p-toluenesulfonic acid.monohydrate was added, and the mixture was refluxed again for around one hour to prepare a coating liquid E-2.

(Preparation of Coating Liquids E-3 to E-6)

Coating liquids E-3 to E-6 were prepared in the similar manner as in the coating liquid E-2 except that the kind and the use amount of each of the metal alkoxide, the compound represented by the formula (3) or (4) (in Table, referred to as "organic component"), the catalyst, and the organic solvent were changed as shown in Table 5.

(Preparation of Coating Liquid C-1)

In a flask, 0.50 g of acetylacetone, 35.08 g of dimethoxyethane, and 15.25 g of 2-butanol were weighed out, and the mixture was stirred to prepare an acetylacetone solution.

In a separate container, 12.55 g of 2-butanol and 1.22 g of aluminum sec-butoxide were weighed out, and the mixture was stirred to prepare an aluminum sec-butoxide/2-butanol solution.

Into the acetylacetone solution prepared previously, an aluminum sec-butoxide/2-butanol solution was added, and the mixture was stirred. Into the resultant mixture, 6.33 g of a 10% by mass ion exchanged water/dimethoxyethane solution was added, and the mixture was stirred to prepare a coating liquid C-1.

(Preparation of Coating Liquid C-2)

Coating liquid C-2 was prepared in the similar manner as in the coating liquid C-1 except that the kind and the mixing amount of the metal alkoxide, and the mixing amount of each of the organic component, the catalyst and the organic solvent were changed as shown in Table 5.

TABLE 5

| Coating liquid No. | Metal alkoxide | Organic component | | Catalyst | Organic solvent | |
|---|---|---|---|---|---|---|
| E-1 | Aluminum sec-butoxide 1.05 g | Phthalimide 0.49 g | 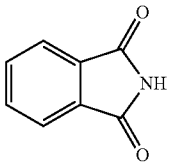 | — | Dimethoxyethane 35.09 g | 2-Butanol 33.57 g |
| E-2 | Aluminum sec-butoxide 1.08 g | Phthalimide 0.48 g | 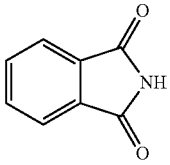 | p-Toluenesulfonic acid × monohydrate 0.084 g | Dimethoxyethane 35.09 g | 2-Butanol 33.61 g |
| E-3 | Aluminum sec-butoxide 1.16 g | Succinimide 0.47 g | 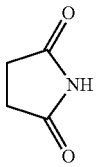 | p-Toluenesulfonic acid × monohydrate 0.090 g | Dimethoxyethane 35.02 g | 2-Butanol 33.54 g |

TABLE 5-continued

| Coating liquid No. | Metal alkoxide | Organic component | | Catalyst | Organic solvent | |
|---|---|---|---|---|---|---|
| E-4 | Aluminum sec-butoxide 1.16 g | 5,5-Dimethylhydantoin 0.46 g | 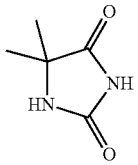 | p-Toluenesulfonic acid × monohydrate 0.092 g | Dimethoxyethane 35.10 g | 2-Butanol 33.36 g |
| E-5 | Aluminum sec-butoxide 1.37 g | Diacetamide 0.43 g | 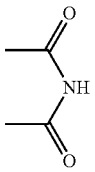 | p-Toluenesulfonic acid × monohydrate 0.11 g | Dimethoxyethane 35.02 g | 2-Butanol 33.21 g |
| E-6 | Zirconium n-propoxide 70% n-propanol solution 2.10 g | 5,5-Dimethylhydantoin 0.86 g | 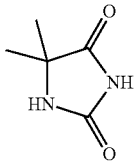 | p-Toluenesulfonic acid × monohydrate 0.17 g | Dimethoxyethane 35.09 g | 2-Butanol 31.91 g |
| C-1 | Aluminum sec-butoxide 1.22 g | Acetylacetone 0.50 g | | Water 0.63 g | Dimethoxyethane 40.78 g | 2-Butanol 27.80 g |
| C-2 | Zirconium n-propoxide 70% n-propanol solution 1.08 g | Acetylacetone 0.46 g | | Water 0.66 g | Dimethoxyethane 40.96 g | 2-Butanol 27.21 g |

<Structure Analysis>

The obtained coating liquid E-1 was placed in an aluminum cup, and fired at 120° C. for 1.5 hours to obtain a structure analysis sample E-1.

As a comparison sample, a structure analysis sample C-1 was prepared by the following method. In a flask, 11.69 g of 2-butanol and 3.35 g of aluminum sec-butoxide were weighed out, and the mixture was stirred to prepare an aluminum sec-butoxide/2-butanol solution. In a separate container, 5.54 g of ion exchanged water and 50.38 g of dimethoxyethane were weighed out, and the mixture was stirred to prepare an ion exchanged water/dimethoxyethane solution.

Into the aluminum sec-butoxide/2-butanol solution prepared previously, ion exchanged water/dimethoxyethane solution was added, and the mixture was heated and refluxed for 30 minutes. The obtained suspension was placed in an aluminum cup, and fired at 120° C. for 1.5 hours to obtain a structure analysis sample C-1.

Using an X-ray photoelectron spectroscopic analyzer "QUANTUM 2000" (trade name, manufactured by ULVAC-PHI, Inc.), analysis of the structure analysis sample E-1 and analysis of the structure analysis sample C-1 were performed by X-ray photoelectron spectroscopy (XPS) under the following measurement conditions.

Measurement Conditions:

X-ray Source: Al Kα ray

X-ray Output: 15 KV, 25 W

Beam diameter: ϕ 100 μm

Measurement area: 300 μm×300 μm

Charge-up compensation: C1s=284.8 eV

Figure 4A:
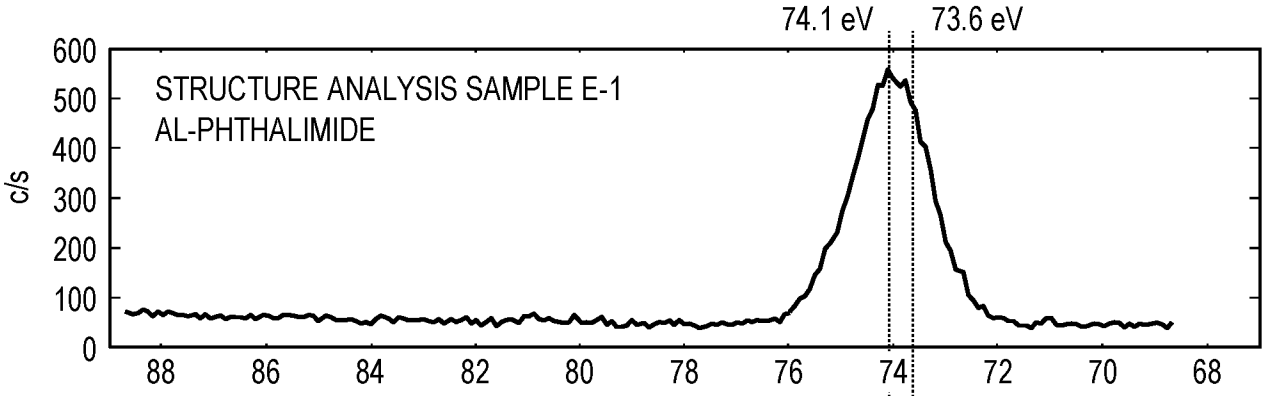
FIGS. 4A and 4B are drawings showing measurement results of the surface layer according to one embodiment of the present invention as determined by X-ray photoelectron spectroscopy.
Figure 4B:
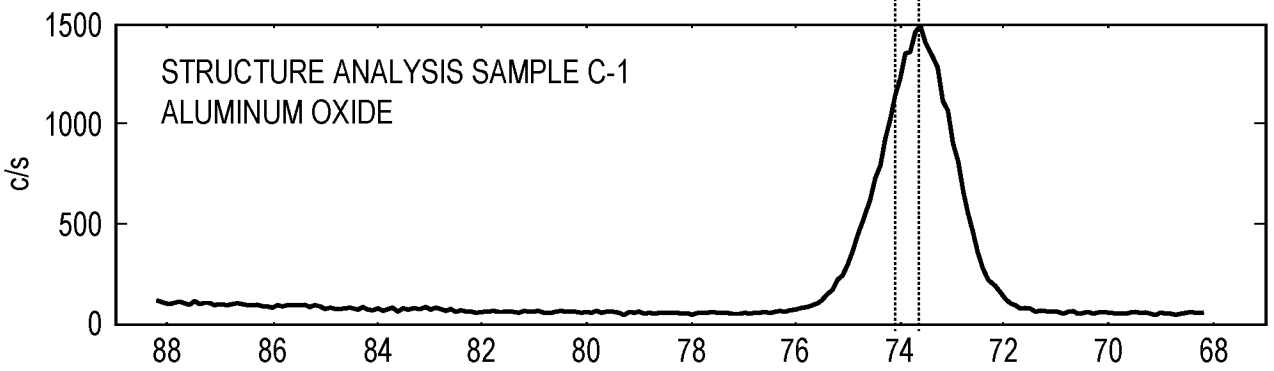

The XPS measurement results of the structure analysis sample E-1 and the structure analysis sample C-1 were shown in FIGS. 4A and 4B. When comparing the measurement results of the structure analysis sample E-1 shown in FIG. 4A with the measurement results of the structure analysis sample C-1 shown in FIG. 4B, it was confirmed that the peak derived from the 2p orbital of aluminum is shifted. From this result, it was suggested that in the structure analysis sample E-1, aluminum and phthalimide are bonded to each other, and the electronic structure of aluminum is changed.

<Preparation of Charging Member>

Example 1: Preparation of Charging Member E-1

A coating liquid E-1 was applied onto the electro-conductive elastic roller A using a ring coating head. Note that the relative movement speed between the electro-conductive elastic roller A and the ring coating head was set to be 100 mm/s, the total discharge amount of the coating liquid from the ring coating head was set to be 0.07 mL, and the discharge speed of the coating liquid from the ring coating head was set to be 0.023 mL/s.

Next, the electro-conductive elastic roller A to which a coating liquid had been applied was fired for 30 minutes in an oven at a temperature of 80° C. to prepare a charging member E-1 having a surface layer on the electro-conductive elastic layer.

Example 2 to 6: Preparation of Charging Members E-2 to E-6

The charging members E-2 to E-6 were prepared in the similar manner as in Example 1 except that each of the coating liquids shown in Table 6 was used.

Comparative Examples 1 and 2: Preparation of Charging Members C-1 and C-2

The charging members C-1 and C-2 were prepared in the similar manner as in Example 1 except that each of the coating liquids shown in Table 6 was used.

<Evaluation>

The following evaluations were performed on the obtained charging members E-1 to E-6 and charging members C-1 and C-2. The evaluation results were shown in order in Table 6.

(Triboelectric Charge Amount)

Figure 5:
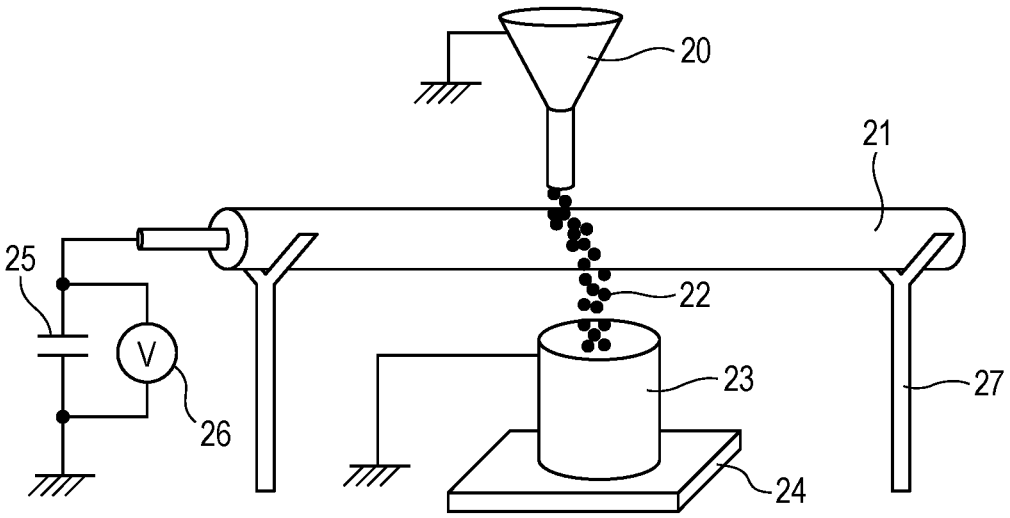
FIG. 5 is a schematic view of a triboelectric charge amount measuring device of the charging member according to one embodiment of the present invention.

The triboelectric charge amount was measured by using each of the prepared charging members. The triboelectric charge amount was measured under the environments of N/N (22° C., 55% RH) using a triboelectric charge amount measuring device (TS100-ASH manufactured by KYOCERA Chemical Corporation) shown in FIG. 5. In FIG. 5, the reference numeral 20 denotes a reference powder inlet, the reference numeral 21 denotes a charging member of a measurement sample, the reference numeral 22 denotes reference powder, the reference numeral 23 denotes a pan, the reference numeral 24 denotes an insulating plate, the reference numeral 25 denotes a meter connection terminal, the reference numeral 26 denotes an electrometer, and the reference numeral 27 denotes a support member of a charging member.

At first, the mass of the pan 23 was measured, and was set to be W1 [g]. Onto the charging member 21 of a measurement sample, a standard carrier for negatively charged polar toner N-01 (trade name) manufactured by The Imaging Society of Japan was dropped for 15 seconds as the reference powder 22 (standard carrier for negatively charged polar toner) from a reference powder inlet 20. After dropping the reference powder, the total charge amount of the charging member 21 was measured by an electrometer 26, and was set to be Q [μC]. In addition, the mass of the entire pan 23 was measured after dropping the reference powder, and was set to be W2 [g]. The triboelectric charge amount Q/M was calculated by the following equation.

$$\text{Triboelectric charge amount } Q/M[\mu c/g]=Q/(W2-W1)$$

(Powder Adhesion)

Figure 6:
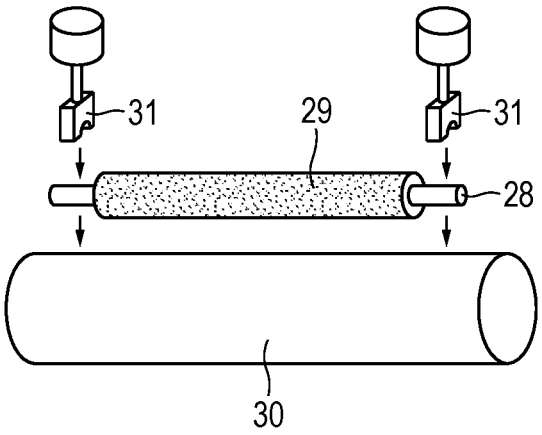
FIG. 6 is a schematic view of a particle adhesion evaluation device of the charging member according to one embodiment of the present invention.

In order to evaluate the dirt adhesion of the charging member, evaluation of the powder adhesion was performed by using each of the prepared charging members. Evaluation was performed under the environments of N/N (22° C., 55% RH) by using a device shown in FIG. 6. In FIG. 6, the reference numeral 28 denotes a charging member, the reference numeral 30 denotes a metal drum, and the reference numeral 31 denotes a contact member of a charging member. The black spots on a surface of the charging member 28 show powder 29 used for powder adhesion evaluation.

At first, the mass of the charging member was measured, and was set to be W3 [g]. A roller was pressed against the rotatable metal drum 30 (ϕ 30) from above with a load of 500 g on one side, and around 0.1 g (w[g]) of DAIMICBEAZ UCN-5090D Clear (trade name) manufactured by Dainichiseika Color & Chemicals Mfg. Co., Ltd. was weighed as the powder 29, and placed evenly on the charging member 28. After that, the metal drum 30 was rotated at 30 rpm for one minute, and the powder was allowed to adhere to the charging member. The charging member 28 to which the powder had adhered was removed from the device, and the mass was weighed and set to be W4 [g]. The powder adhesion rate (%) was calculated by the following equation.

$$\text{Powder adhesion rate } (\%)=\{(W4-W3)/w\}\times 100$$

In a case where the powder adhesion amount of the charging member is large, the powder adhesion rate becomes large, and in a case where the powder adhesion amount of the charging member is small, the powder adhesion rate becomes small. It was found that the charging members E-1 to E-6 each have a small powder adhesion rate, and the powder adhesion amount of the charging member is small.

(Dirt Adhesion Amount)

Multiple cyan cartridges for a laser printer (trade name: Color LaserJet CP4525, manufactured by HP) were prepared. The charging member that had been mounted to the cyan cartridge was removed, and each of the charging members that had been prepared previously was mounted. Subsequently, the above-described cartridge was set in the printer manufactured by HP, 12000 half-tone images were output, and then the degree of the adhesion of dirt on the charging member was visually observed, and evaluated based on the following criteria.

Rank A: adhesion amount is small

Rank B: adhesion was observed

Rank C: adhesion amount is large

In the charging members E-1 to E-6, the charging member was positively charged (the reference powder side was negatively charged), and the adhesion of dirt on the charging member was small.

On the other hand, in the charging member C-1, the charging member was weakly positively charged (the reference powder side was weakly negatively charged), and the adhesion of dirt on the charging member was large. Further, in the charging member C-2, the charging member was negatively charged (the reference powder side was positively charged), and the adhesion of dirt on the charging member was large.

TABLE 6

| | Charging member No. | Coating liquid No. | Metal atom | Organic component structural formula | Charging member Q/M (μC/g) | Powder adhesion rate (%) | Dirt adhesion amount |
|---|---|---|---|---|---|---|---|
| Example 1 | E-1 | E-1 | Al | 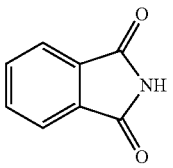 | 0.125E−03 | 23.8 | B |

TABLE 6-continued

| | Charging member No. | Coating liquid No. | Metal atom | Organic component structural formula | Charging member Q/M (μC/g) | Powder adhesion rate (%) | Dirt adhesion amount |
|---|---|---|---|---|---|---|---|
| Example 2 | E-2 | E-2 | Al | 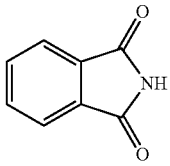 | 0.166E-03 | 14.7 | A |
| Example 3 | E-3 | E-3 | Al | 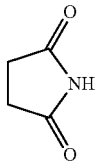 | 0.482E-03 | 14.3 | A |
| Example 4 | E-4 | E-4 | Al | 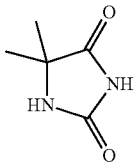 | 0.487E-03 | 17.2 | A |
| Example 5 | E-5 | E-5 | Al | 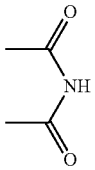 | 0.831E-03 | 13.4 | A |
| Example 6 | E-6 | E-6 | Zr | 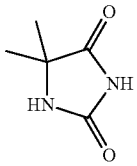 | 0.103E-03 | 24.5 | B |
| Comparative Example 1 | C-1 | C-1 | Al | 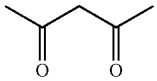 | 0.096E-03 | 32.3 | C |
| Comparative Example 2 | C-2 | C-2 | Al | 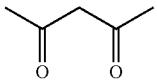 | −0.182E-03 | 34.8 | C |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-247848, filed Dec. 21, 2016, which is hereby incorporated by reference herein in its entirety.

What is claimed is:

1. A charging member comprising:

a support; and a surface layer on the support, wherein, the surface layer includes polymetalloxane containing at least one metal atom selected from the group consisting of aluminum, zirconium, titanium, and tantalum, and a group represented by the following formula (1) or (2) is bonded to the at least one metal atom in the polymetalloxane, (1)

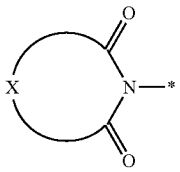

-continued (2)

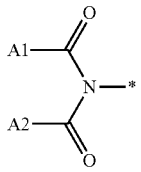

wherein, in formula (1), X represents an atomic group required for forming a ring; in formula (2), A1 and A2 each independently represent a hydrogen atom or an alkyl group, and in formulas (1) and (2), a symbol "*" represents a binding site with a metal atom in the polymetalloxane.

2. The charging member according to claim 1, wherein a triboelectric charge amount (Q/M) of the charging member is $0.1\times10^{-3}$ (0.1 E-3) μC/g or more as measured using a standard carrier for negatively charged polar toner.

3. The charging member according to claim 1, wherein a group represented by the formula (1) is any one of groups represented by the following formulas (1a) to (1f).

(1a)

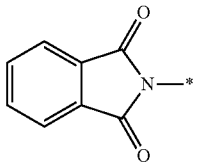

(1b)

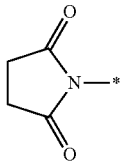

(1c)

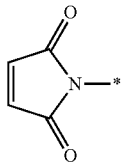

(1d)

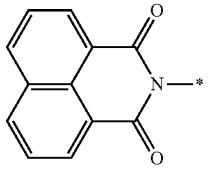

(1e)

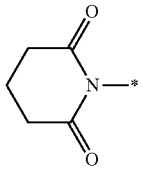

-continued (1f)

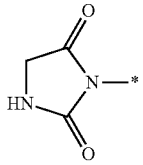

4. A method for producing a charging member including a support and a surface layer on the support, the surface layer containing polymetalloxane, and a step for forming the surface layer including obtaining the polymetalloxane by reacting a metal alkoxide containing at least one metal selected from the group consisting of aluminum, zirconium, titanium, and tantalum with a compound represented by the following formula (3) or (4), (3)

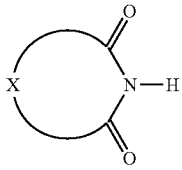

(4)

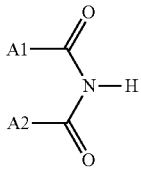

wherein, in formula (3), X represents an atomic group required for forming a ring, in formula (4), A1 and A2 each independently represent a hydrogen atom or an alkyl group.

5. The method for producing a charging member according to claim 4, wherein the addition amount of the compound represented by the formula (3) or (4) is 0.2 mol or more and 3 mol or less based on one mol of the metal alkoxide.

6. The method for producing a charging member according to claim 4, wherein the compound represented by the formula (3) is any one of compounds represented by the following formulas (3a) to (3f).

(3a)

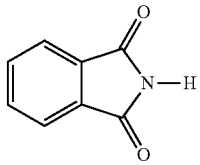

(3b)

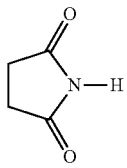

-continued (3c)

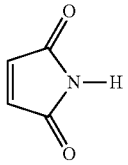

(3d)

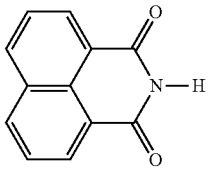

(3e)

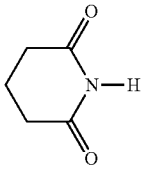

(3f)

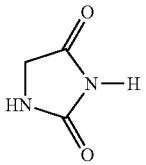

7. A process cartridge comprising:

an electrophotographic photosensitive member; and a charging member arranged so as to be chargeable to a surface of the electrophotographic photosensitive member, the process cartridge being configured so as to be attachable to and detachable from a main body of an electrophotographic apparatus, the charging member including a support, and a surface layer on the support, the surface layer including polymetalloxane containing at least one metal atom selected from the group consisting of aluminum, zirconium, titanium, and tantalum, and a group represented by the following formula (1) or (2) being bonded to the at least one metal atom in the polymetalloxane, (1)

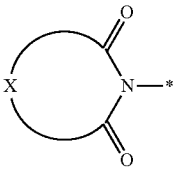

(2)

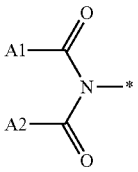

wherein, in formula (1), X represents an atomic group required for forming a ring, in formula (2), A1 and A2 each independently represent a hydrogen atom or an alkyl group, and in formulas (1) and (2) a symbol "*" represents a binding site with a metal atom in the polymetalloxane.

* * * * *